US006006547A

United States Patent [19]

Bergagnini

[11] Patent Number: 6,006,547

[45] Date of Patent: Dec. 28, 1999

[54] JEWELRY ASSEMBLY WITH DROPPED STONE

[75] Inventor: Norberto Bergagnini, New York, N.Y.

[73] Assignee: Sanderg & Sikorski Diamond Corp., New York, N.Y.

[21] Appl. No.: 09/153,478

[22] Filed: Sep. 15, 1998

Related U.S. Application Data

[63] Continuation-in-part of application No. 29/092,606, Aug. 24, 1998, Pat. No. Des. 412,460, and application No. 29/092, 618, Aug. 24, 1998.

[51] Int. Cl.[6] ..... A44C 17/02

[52] U.S. Cl. ..... 63/26; 63/23; D11/79; D11/91

[58] Field of Search ..... 63/23, 26, 27, 63/28; D11/79, 91

[56] References Cited

U.S. PATENT DOCUMENTS

| | | | |
|---|---|---|---|
| 237,989 | 2/1881 | Meyer | 63/26 |
| D. 337,964 | 8/1993 | Garfolo | D11/79 |
| D. 412,460 | 8/1999 | Bergagnini | D11/79 |
| 483,214 | 9/1892 | Gaynor . | |
| 1,186,271 | 6/1916 | Block | 63/28 |
| 2,729,955 | 1/1956 | Jay | 63/27 X |
| 3,910,066 | 10/1975 | Strack . | |
| 4,353,765 | 10/1982 | Covi et al. . | |
| 4,935,268 | 6/1990 | Pöll . | |
| 5,077,988 | 1/1992 | Pöll . | |
| 5,090,217 | 2/1992 | Beber et al. | 63/27 |
| 5,188,679 | 2/1993 | Kretchmer | 63/26 X |
| 5,548,976 | 8/1996 | Slowinski | 63/28 |
| 5,622,061 | 4/1997 | Sakata . | |
| 5,682,769 | 11/1997 | Baker | 63/26 X |
| 5,848,539 | 12/1998 | Ouzounian | 63/28 |

FOREIGN PATENT DOCUMENTS

| | | | |
|---|---|---|---|
| 2405041 | 6/1979 | France | 63/26 |
| 2491308 | 4/1982 | France | 63/26 |
| 180882 | 9/1962 | Sweden | 63/27 |

*Primary Examiner*—Terry Lee Melius
*Assistant Examiner*—Andrea Chop
*Attorney, Agent, or Firm*—Gottlieb, Rackman & Reisman, P.C.

[57] ABSTRACT

A jewelry assembly in which a jewelry stone is retained such that it extends substantially beyond its setting is provided. The jewelry assembly comprises a jewelry stone having a table portion, a girdle, and a depending portion, as is well known in the art. The assembly also includes a retaining element in which the stone is set comprising a pair of side bars for engaging opposite locations of the girdle of the stone, as well as a bridge element extending between the side bars which wraps underneath the depending portion of the stone such that a significant portion of the stone extends past the ends of the side bars.

7 Claims, 2 Drawing Sheets

FIG. 1
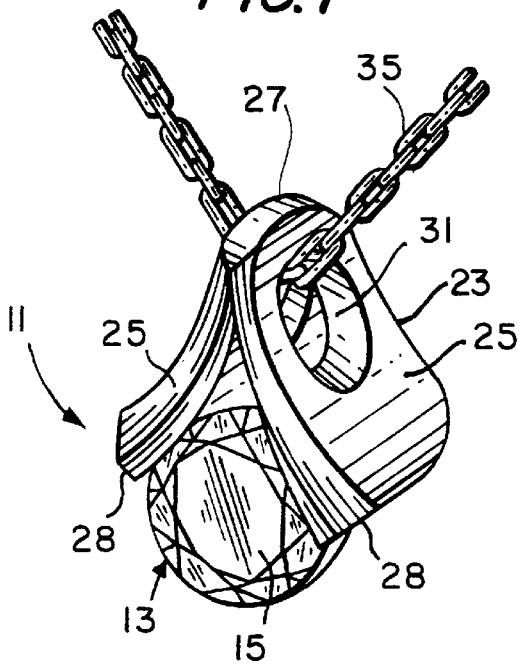
FIG. 2
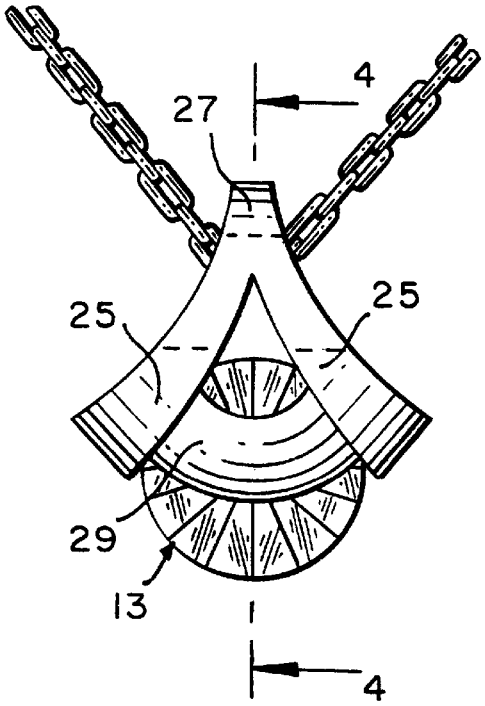
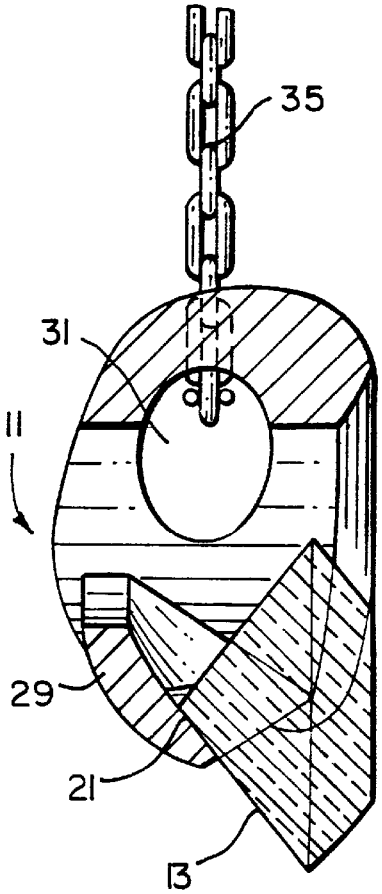
FIG. 4
FIG. 3
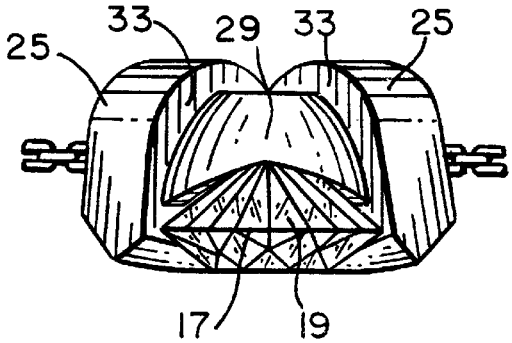

FIG. 5
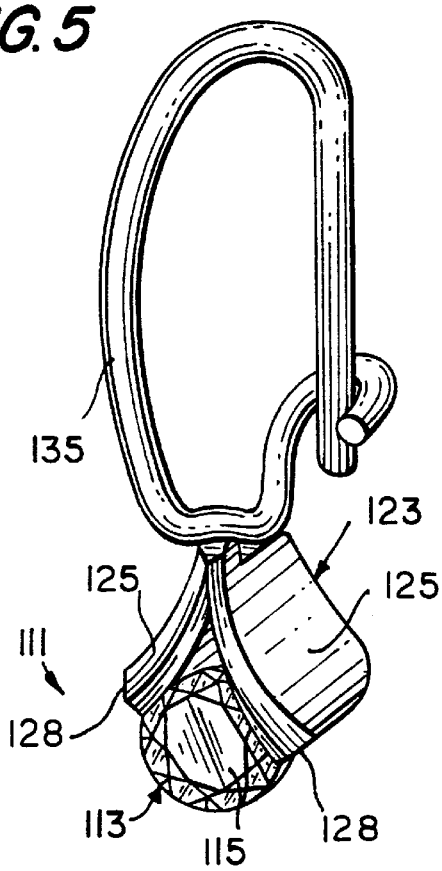
FIG. 6
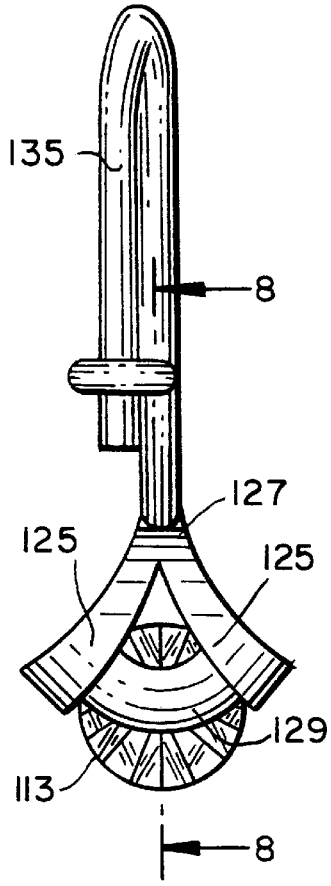
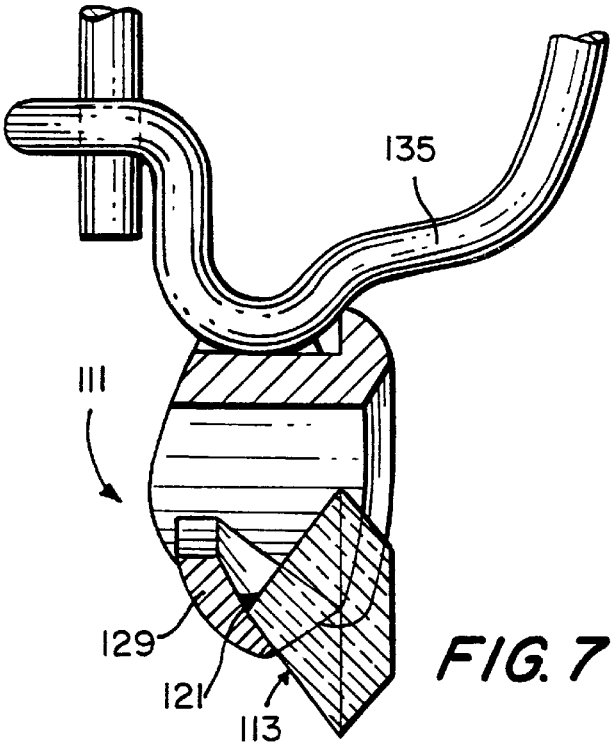
FIG. 7
FIG. 8
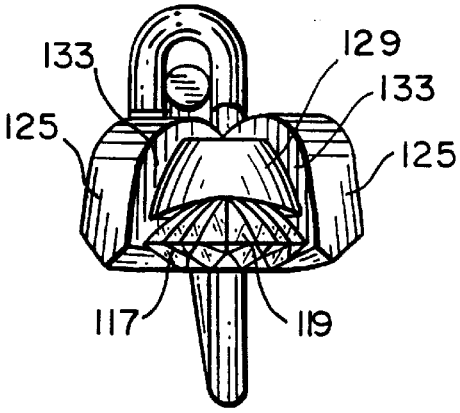

JEWELRY ASSEMBLY WITH DROPPED STONE

This application is a continuation-in-part of application Ser. No. 29,092,606 filed Aug. 24, 1998, now Design Pat. No. 412,460, and application Ser. No. 29/092,618 filed Aug. 24, 1998.

BACKGROUND OF THE INVENTION

This application describes a jewelry assembly, and more particularly, a jewelry assembly having a setting in which a substantial portion of a stone extends out thereof.

Conventional settings for diamonds and other precious and semi-precious stones generally comprise a conventional "box" setting in which a plurality of prongs are used to hold the diamond or other stone. However, in such conventional settings, no portion of the stone extends past the prongs, limiting viewing of the stone only from its top.

Accordingly, it would be desirable to provide a jewelry article in which a stone is disposed in a setting such that a substantial portion of the entire stone extends beyond the setting, thereby providing an improved overall visual design.

SUMMARY OF THE INVENTION

Generally speaking, in accordance with the invention, a jewelry assembly in which a jewelry stone is retained such that it extends substantially beyond its setting is provided. The jewelry assembly comprises a jewelry stone having a table portion, a girdle, and a depending portion, as is well known in the art. The assembly also includes a retaining element in which the stone is set comprising a pair of side bars or walls for engaging opposite locations of the girdle of the stone, as well as a bridge element extending between the side bars which wraps underneath the depending portion of the stone such that a significant portion of the stone extends past the ends of the side bars.

In the preferred embodiment, the side bars have first upper ends joined together; the second lower ends engage the girdle of the jewelry stone where preferably the portion of the stone that extends past these lower ends comprises up to 65% of the entire stone.

While the preferred stone is of a conventional round configuration, other shaped stones may be used, such as marquise, pear, princess cut, etc.

The inventive jewelry assembly may be used in conjunction with a necklace, a bracelet, earring or other jewelry item in order to create a unique visual design.

Accordingly, it is an object of this invention to provide an improved jewelry design assembly.

Another object of the invention is to provide a jewelry design assembly which is aesthetically pleasing when viewed.

A further object of the invention is to provide a jewelry design assembly which has an enhanced gem or stone presentation.

Still other objects and advantages of the invention will in part be obvious, and in part be apparent from the following description.

The invention accordingly comprises a jewelry design possessing the features, properties and relation of components which will be exemplified in the designs hereinafter described, and the scope of the invention will be indicated in the claims.

BRIEF DESCRIPTION OF THE DRAWINGS

For a fuller understanding of the invention, reference is made to the following description, taken in connection with the accompanying drawings, in which:

FIG. 1 is a perspective view illustrating the jewelry assembly of the invention attached to a necklace;

FIG. 2 is a front elevational view of the jewelry assembly depicted in FIG. 1;

FIG. 3 is a bottom plan view of the jewelry assembly depicted in FIG. 1;

FIG. 4 is a cross-sectional view taken along line 4—4 of FIG. 2;

FIG. 5 is a perspective view of the jewelry assembly of the invention used as an earring;

FIG. 6 is a front elevational view of the jewelry assembly depicted in FIG. 5;

FIG. 7 is a bottom plan view of the jewelry assembly depicted in FIG. 5; and FIG. 8 is a cross-sectional view taken along line 8—8 of FIG. 6.

DETAILED DESCRIPTION OF THE PREFERRED EMBODIMENT

Referring first to FIGS. 1–4, jewelry assembly 11, made in accordance with the invention, is shown attached to a jewelry chain 35 of a necklace or bracelet. Jewelry assembly 11 includes a jewelry stone of a round configuration and made of a diamond or other precious or semi-precious stone material. Stone 13 has a table portion 15, a girdle 17, and a tapered portion 19 depending from girdle 17 and leading to a culet 21 (see FIG. 4), as is well known.

Jewelry assembly 11 further includes a retaining element generally indicated at 23 in which stone 13 is set. Retaining element 23 is made from gold, silver or some other metal, and is defined by a pair of joined side bars 25. Side bars 25 have first top ends joined together at 27, and second ends 28 flaring outward. Together side bars 25 have a substantially V-shaped configuration with each side bar having an inside wall 33 for engaging opposite locations along girdle 17 of stone 13.

As best shown in FIGS. 2 and 3, retaining element 23 further includes an arcuate-shaped bridge 29 connected between side bars 25 just above lower ends 28. Element 23 wraps underneath depending portion 19 of stone 13 (see FIG. 3).

As can be appreciated from viewing FIGS. 1 and 2, a substantial portion of stone 13 extends past ends 28 of retaining element side bars 25. The portion of stone 13 which extends past retaining element 23 may be up to 65%. of the entire stone. Preferably, the portion of stone 13 which extends past element 23 is in the range of 40% to 60% of the entire stone.

Referring to FIG. 1, each of side bars 25 of retaining element 23 is formed with an aligned hole 31 through which chain 35 may extend. Consequently, jewelry assembly 11 can be used as part of a necklace, bracelet or other jewelry chain item in order to provide a unique visual design.

Turning now to FIGS. 5 through 8, a jewelry assembly 111, made in accordance with the invention, and in the form of an earring unit, is shown. As before, jewelry assembly 11 includes a round configured stone 113 having a table portion 115, a girdle portion 117, and a depending tapered portion 119 leading to a culet 121. Assembly 111 also includes a retaining element 123, in which stone 113 is set. Retaining element 123 includes a pair of side bars 125 with inside walls 133 engaged against girdle 117 of stone 113. Retaining element 123 also includes a bridge 129 which wraps underneath depending tapered portion 119 of stone 113. As before, a substantial portion of stone 113 extends past the lower ends of side bars 125. In the embodiment described in FIGS. 5–8, jewelry assembly 111 is incorporated into an earring unit. In particular, an earring wire 135, as is well known in the art, is fixed to top portion 127 of retaining element 123.

In order to manufacture the jewelry assembly of the invention, a model of the assembly is first prepared (usually in silver) about which a rubber mold is disposed. Then, the model is removed from the rubber mold, after which wax is injected into the cavity of the rubber mold in order to create a wax form of the assembly. The stone is then set in position in the wax form of the assembly. After separating the wax with the set stone from the rubber mold, the wax form is cast into gold, as is well known in the art. The casting is achieved in an oven set at a temperature of about 1200° F. for white gold or 1150° F. for yellow gold. Once standard preparation steps are carried out on the cast piece, such as removal of casting gates and cleaning by the jeweler, the final polishing takes place.

Manufacture of the jewelry assembly in the manner set forth above facilitates securing the chosen stone in place in the retaining element. Particularly, by first placing the stone in the wax, after which the wax with the placed stone is heated to high temperatures during casting, the inventive assembly can be produced.

Although the two embodiments of the inventive jewelry assembly are shown with respect to earrings and bracelets/necklaces, the design is also applicable for rings, pendants and other jewelry items.

Although the stone used in each embodiment is a round stone, other shaped stones, such as square, pear, marquise, oval and princess cut may be used without departing from the spirit and scope of the invention.

It will thus be seen that the objects set forth above, among those made apparent from the preceding description, are efficiently attained, and, since certain changes may be made in the design and construction set forth, without departing from the spirit and scope of the invention, it is intended that all matter contained in this description and shown in the drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

I claim:

1. A jewelry assembly comprising:

a jewelry stone having a top surface, a girdle and a depending portion below the girdle;

a retaining element defining an opening for at least partially receiving said stone and having an inside wall which engages only two locations along said girdle between which an arc of less than 180° alone said girdle is defined and located substantially within said opening and a cooperating bridge element wrapping underneath said stone such that said depending portion is supported thereunder by said bridge element with at least a portion of said stone extending past said retaining element.

2. The assembly of claim 1, wherein said retaining element includes a pair of side bars each having an inside wall that engages one of the two locations along said girdle.

3. The assembly of claim 2, wherein said side bars have first upper ends joined together and second lower ends past which said jewelry stone extends.

4. The assembly of claim 2, wherein said portion of said stone that extends past said side bars comprises no greater than 65% of the size of the stone.

5. The assembly of claim 2, wherein said portion of the stone extending past the side bars is in an amount between about 40% and 60% of the size of the stone.

6. The assembly of claim 2, wherein said bridge element extends between said side bars.

7. The assembly of claim 1, wherein said stone is selected from the group consisting of a round stone, marquise stone, pear-shaped stone, oval stone and square stone.

* * * * *